US008118146B2

(12) United States Patent
Shalgi

(10) Patent No.: US 8,118,146 B2
(45) Date of Patent: Feb. 21, 2012

(54) WHEELED LUGGAGE CASE

(76) Inventor: Netta Shalgi, Herzliya (IL)

( * ) Notice: Subject to any disclaimer, the term of this patent is extended or adjusted under 35 U.S.C. 154(b) by 163 days.

(21) Appl. No.: 12/497,739

(22) Filed: Jul. 6, 2009

(65) Prior Publication Data

US 2010/0163359 A1 Jul. 1, 2010

(51) Int. Cl.
*A45C 5/14* (2006.01)

(52) U.S. Cl. ..... 190/18 A; 190/107; 190/18 R; 280/47.315; 280/47.17; 16/47

(58) Field of Classification Search ..... 16/45–48; 280/47.315, 47.371, 37, 655, 645, 47.17, 280/47.2; 190/18 A, 18 R, 107
See application file for complete search history.

(56) References Cited

U.S. PATENT DOCUMENTS 320,554 A * 6/1885 Harmon ..... 384/551
481,963 A * 9/1892 Minor ..... 16/46
4,118,048 A * 10/1978 Spranger et al. ..... 280/47.35
4,160,495 A * 7/1979 Conard ..... 190/18 A
4,322,869 A * 4/1982 Jordan ..... 16/46
4,979,598 A * 12/1990 Verheij et al. ..... 190/18 A
5,277,449 A * 1/1994 Schmidt ..... 280/655
6,076,641 A * 6/2000 Kinzer et al. ..... 190/18 A
6,149,168 A * 11/2000 Pauser et al. ..... 280/47.371
6,626,453 B1 * 9/2003 Theus et al. ..... 280/652

OTHER PUBLICATIONS

Walk'N'Roll bag: Final Project of Liron Hartman, student in the "Israeli Design Center", Holon, Israel, Published Jul. 12, 2008. http://www.israelidesign.co.il/magazine_item_2026.html.
Sleeping Suitcase: Designed by krystian kwiecinski from poland, participated in a design competition, "Shelter in a Cart", organized by "designboom". Year 2006.
Live Luggage as seen in http://www.liveluggage.corn/Category/Classic-Series/21/Released Jun. 26, 2008.
"O bag" design by Rooz Mousavi, published by Yanko Design in website: http://www.yankodesign.com/2008/09/22/rolling-bag-literally at Sep. 22, 2008.

* cited by examiner

*Primary Examiner* — Tri Mai
(74) *Attorney, Agent, or Firm* — Law Offices of Edward Langer Adv. and Patent Attorney

(57) ABSTRACT

An improved wheeled luggage case having a pair of freely rotating large wheels that have a diameter substantially greater than the height of the center of gravity of the wheeled luggage case itself (when in an upright, at rest position). The weight of the wheeled luggage case is largely transferred to the large wheel pair when being towed, reducing the load burden on a user and making it easier to pull the wheeled luggage case over long distances, for example, between airport terminals.

13 Claims, 5 Drawing Sheets

WHEELED LUGGAGE CASE

FIELD OF THE INVENTION

The present invention generally relates to wheeled luggage, and in particular, to an improved wheeled luggage case.

BACKGROUND OF THE INVENTION

Luggage today, especially, luggage carried on board mass transport, such as airlines, buses and trains, are provided with features such as straps and/or built-in extension handles and either plastic or metal slider "feet" or miniature wheels. In the prior art, two to four small wheels mounted on the base of the luggage—or even on other surfaces to facilitate moving the luggage when the wheels in the base are not in a correct position to roll on a surface—are provided for rolling, generally without an axle, but the weight in pulling such a load is mostly on a user and not primarily on the wheels since the luggage generally needs to be tilted on two wheels to more readily move it.

These features are designed to facilitate sliding or rolling luggage over paved concourses and for general movement within stations and between arrival and departure terminals which may be separated by quite a walking distance. But such features generally do not fully ease the burden of pulling a load across various floor surfaces, both indoor and outdoor and over obstacles such as curbing and stairs encountered in unexpected places.

Most mass transportation centers offer assistance to travelers with personal luggage which needs to be moved across large walking distances by providing porter service or large, four-wheeled baggage carts, but aside from the added expense of such a service, it is not always available, either due to lack of baggage carts, especially at peak hours of travel, or because the central collection points for the baggage carts are not conveniently located so as to be immediately useful to a traveler.

Another solution is to use a portable, light-weight mini-dolly that folds-up when not in use, but this is an added expense and the folded mini-dolly may be inconvenient to carry when not in use and may be damaged in transit. Furthermore, a mini-dolly is generally not well-suited for pulling fully-loaded and heavy luggage across long distances. Luggage provided with miniature wheels, and mini-dollies in general, are inappropriate for navigating stairs or crossing street curbing when trying to bring luggage as close as possible to a waiting vehicle. Baggage carts are especially not able to traverse stairs to reach another floor of a terminal, and can't be used without ramps or elevators which are often inconveniently located.

In addition, modern travelers, especially businessmen, are likely to have laptops to carry, but having their hands full, may find it awkward to also pull luggage around, with or without the extra concern for managing the use of a baggage cart or mini-dolly.

Thus it would be desirable to provide a light-weight, sturdy, improved wheeled luggage case that would be easily movable over a variety of surfaces, including stairs, without the need for baggage carts or mini-dollies, and which has a low center of gravity to ease the burden of moving personal goods, such as clothing and accessories, from place to place while traveling.

SUMMARY OF THE INVENTION

Accordingly, it is a broad object of the present invention to overcome the above-mentioned disadvantages of the prior art by providing an improved wheeled luggage case having a pair of freely rotating large wheels that have a diameter substantially greater than the height of the center of gravity of the wheeled luggage case itself (when in an upright, at rest position). The weight of the wheeled luggage case is largely transferred to the large wheel pair when being towed, reducing the load burden on a user and making it easier to pull the wheeled luggage case over long distances, for example, between airport terminals.

It is another object of the present invention to provide a wheeled luggage case that can easily and efficiently be navigated over stairs and street curbing to move the wheeled luggage case between different levels with a minimum of user effort.

It is yet another object of the present invention to provide a wheeled luggage case having a large wheel pair rotatably mounted at the lower portion of a storage chamber integrally formed with a base. The wheeled luggage case can be oriented into an upright, immobilized position resting on the base and a foot member, where the foot member is formed as part of the base extending outward on one side of the wheeled luggage case. The wheeled luggage case can be oriented into a wheeled position by tilting an extendable towing rod fixedly attached to an opposite side of the wheeled luggage case.

It is still another object of the present invention to provide a wheeled luggage case with a multi-sectioned cover defining an opening for allowing partial or full access to an interior storage chamber.

It is a further object of the present invention to provide a narrow inside pocket formed on an inside surface of a multi-sectioned cover to a wheeled luggage case suitable for accommodating a thin-profile electronic device, such as a laptop computer which is easily accessible to a user, yet secure and out of sight when stored for traveling.

Thus there is provided a wheeled luggage case having a towing rod for towing, the wheeled luggage case comprising:

- a storage chamber for holding personal goods, apparel and accessories and provided with a base;
- a multi-sectioned cover defining an opening on one side of the storage chamber for providing access thereto;
- a pair of freely rotating large wheels mounted on a common axis on each side of a lower portion of the storage chamber and having an inner rim upon which a set of smaller wheels fixedly attached to the storage chamber rotate; and
- a foot member fixedly formed on a first edge of the base for immobilizing the wheeled luggage case, such that when the storage chamber is closed with the multi-sectioned cover and the wheeled luggage case is tilted at a forward angle by action of the towing rod, the foot member is lifted away from contact with a floor surface allowing movement of the wheel luggage case, the large wheels bearing most of the weight of the wheeled luggage case, the weight being distributed among the set of smaller wheels, relieving the load stress on a user; and when the storage chamber is tilted into an upright position by action of the towing rod, the foot member on the base maintains the wheeled luggage case in an immobilized rest position.

Although the foot member, acting in concert with the base of the storage chamber of a wheeled luggage case, immobilizes it, it is quite easy to resume movement by simply pulling on a strap or towing rod and/or handle (as are commonly found on luggage cases) attached to the exterior of the storage chamber to tilt it at a slight angle. This raises the foot member and base from contact with a floor or other surface and allows the large wheel pair to contact the floor and to take up the weight of the wheeled luggage case and rotate forward. The large wheel pair, in one embodiment of the present invention, are slightly raised above a floor when the foot member is engaged, and when the foot member is levered upward by tilting the wheeled luggage case, the large wheel pair are again in full rolling contact with the floor.

In an alternate embodiment of the present invention, the wheels may also be in contact with a surface simultaneously with the foot member and base to provide additional support to a wheeled luggage case when in an upright, rest position.

The luggage is especially sized so as to meet the stringent requirements of under-the-seat storage aboard aircraft, or for storage in overhead compartments.

A third small wheel is optionally used to provide further stability when pulling the wheeled luggage case over flat surfaces so as not to burden a user with any weight load of the wheeled luggage case.

In a first preferred embodiment of the present invention (see FIG. 1), the storage chamber is provided with reinforced ribbing for added strength enabling sitting on it when put in a prone position. In a low-profile, cylindrical embodiment of the present invention, the storage chamber is sufficiently strong to serve as a sturdy platform on which to sit. In the latter embodiment, the foot member is in contact with the floor to safely immobilize the wheeled luggage case.

In a preferred embodiment of the present invention, the large wheel pair are made of rubber/silicone to enable rolling over various grades and conditions of flooring and under adverse conditions, such as rolling over small stones, and over snow-covered, or icy surfaces.

Optionally, a battery-operated light is provided within the storage chamber which lights when the cover is opened so as to provide illumination so a traveler can inspect the contents under conditions of poor external lighting and at night.

Other features and advantages of the present invention will become apparent from the drawings and the description given below.

BRIEF DESCRIPTION OF THE DRAWINGS

For a better understanding of the present invention with regard to the embodiments thereof, reference is made to the accompanying drawings, not to scale, in which like numerals designate corresponding elements or sections throughout, and in which.

DETAILED DESCRIPTION OF THE PREFERRED EMBODIMENTS

FIGS. 1A-D are side views of a wheeled luggage case constructed in accordance with a preferred embodiment of the present invention.

Figure 3:
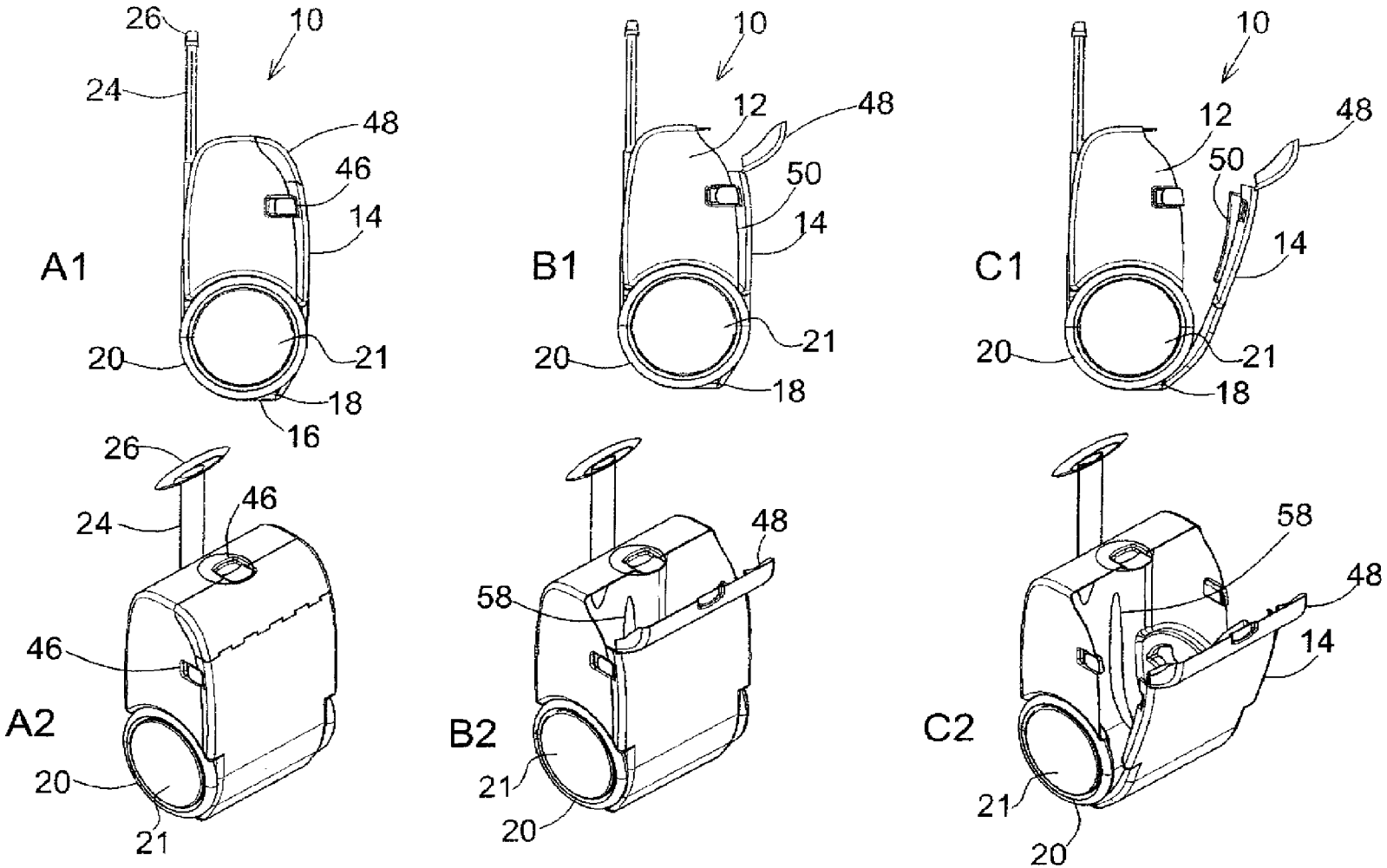
FIGS. 3A-C show side and three-quarter views to illustrate three stages in the opening of the multi-sectioned cover of the wheeled luggage case of FIG. 1.

Referring now to FIG. 1A, wheeled luggage case 10 is shown in an upright, rest mode and comprises a storage chamber 12 having a multi-sectioned cover 14 secured by standard quick-release fasteners, such as a clasp 46, and a base 16 advantageously formed with a foot member 18 for immobilizing wheeled luggage case 10. The wheeled luggage case 10 is provided with a pair of large wheels 20 (shown as a single wheel in a side view) which are rotatably mounted directly to opposite sides of a lower portion of storage chamber 12 (see also FIG. 3) and provided with a closed, wheel cover 21.

Figure 5:
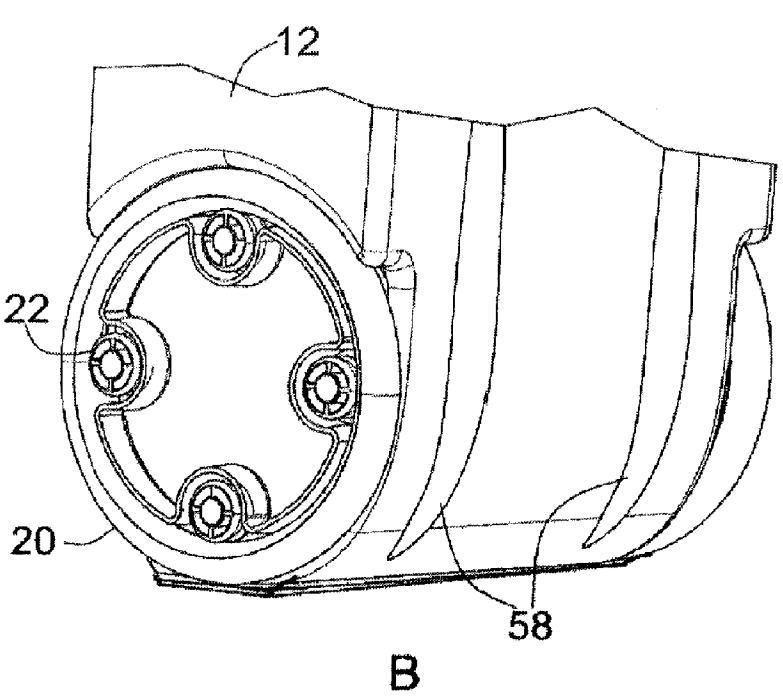
FIGS. 5A and 5B are enlarged, detailed views of the large wheel pair of FIG. 1.
Figure 5:
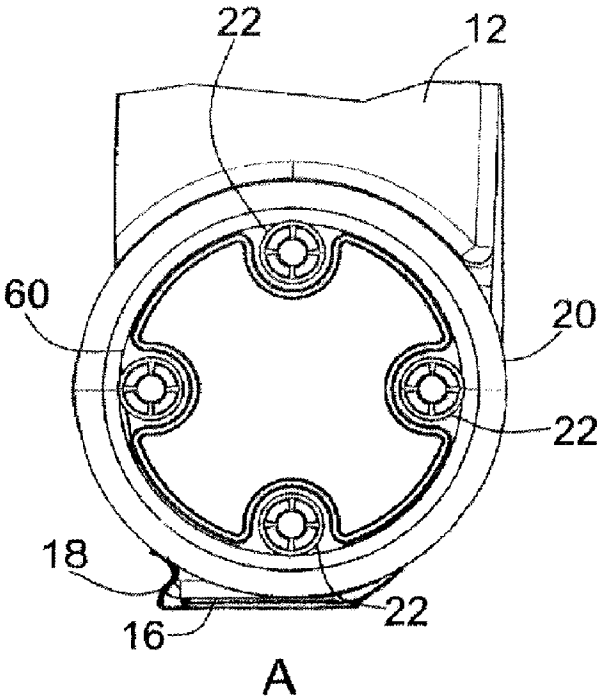

In FIG. 1A, one preferred method of resting wheeled luggage case 10 in an upright position is to use both base 16 disposed at right angles to the sides of storage chamber 12 and the large wheel pair 20 to support the weight of wheeled luggage case 10 on flat surface 28, but in another preferred embodiment of the present invention, the large wheel pair 20 is raised slightly off the surface 28 so as not to be in rolling contact with it when the foot member and base are in contact with surface 28 (see FIG. 5). Alternatively, the large wheel pair 20, as well as at least one optional small wheel (not shown) may bear some of the weight of the wheeled luggage case 10 with the base 16 and foot member. Additionally, or alternatively, a small, foot stop (not shown) extending downward from base 16 may be used in combination with large wheel pair 20 to immobilize wheeled luggage case 10 when in an upright, rest position.

Foot member 18 is formed as an integral extension of base 16, extending outward on one side of wheeled luggage case 10 to help maintain the luggage case 10 in an upright position. Towing rod 24 and handle 26 are provided to manipulate wheeled luggage case 10.

The inventive wheeled luggage case 10 may be modified by the addition of a small wheel (not shown) to allow towing the wheeled luggage case in the upright position by using a strap or cable (not shown). The cable (not shown) is optionally provided and can be pulled out from handle 26 for towing wheeled luggage case 10, and retracted by use of a rewind spool and spring mechanism (not shown).

As shown in FIG. 1B, towing rod 24 needs to be only slightly tilted downward (curved arrow) in order for the foot member 18 and base 16 to tilt upward (curved arrow) away from a floor surface 28 at an equal and opposite angle, enabling wheeled luggage case 10 to be moved freely and easily on the large wheel pair 20 which now comes into rolling contact with surface 28.

Figure 1:
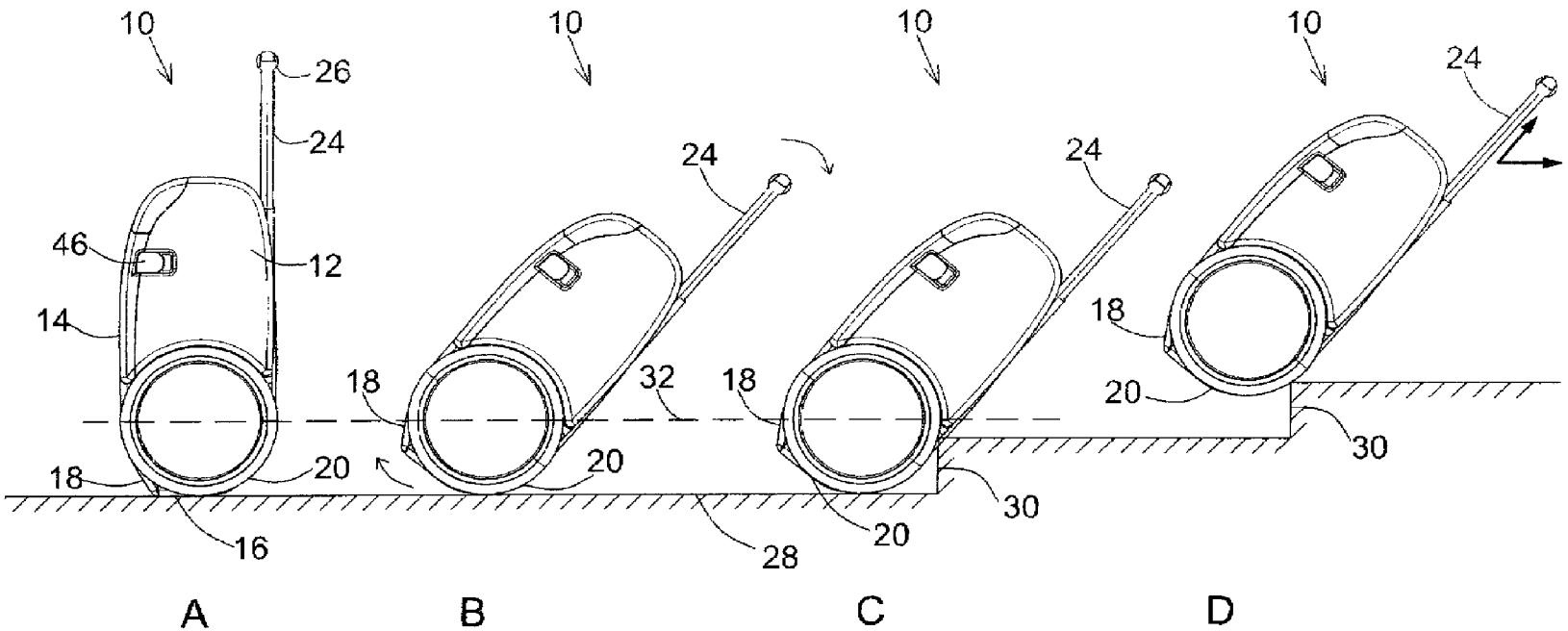
FIGS. 1A-D are side views of a wheeled luggage case constructed in accordance with a preferred embodiment of the present invention.

Referring to FIGS. 1C-D, the large size of the wheel pair 20 in respect to storage chamber 12, in general allows wheeled luggage case 10 to efficiently and comfortably navigate stairs and curbing on streets—obstacles frequently encountered by travelers with wheeled luggage. The large wheel pair 20 is about ⅓ the height of storage chamber 12 in the embodiment of the present invention shown in FIG. 1. The large wheel pair 20 provides a good attack angle in approaching the risers 30 of standard construction stairs (or street curbing), which usually are between 15 and 20 cm. in height, and assist in easily raising the wheeled luggage case to a higher level.

The large wheel pair 20 raises the tipping angle of the wheeled luggage case 10 itself to almost half the height of the large wheel pair 20 (practically to their center). Thus, when tilted, a large portion of the weight load of the wheeled luggage case 10 is transferred to the large wheel pair 20 so as to divide the weight of the wheeled luggage case 10 into two portions: one above and one below a line 32 representing the central axis and center-of-gravity of large wheel pair 20 (see FIGS. 2A-C). The weight in each portion balances the weight in the other causing a greater portion of the total weight that was until now borne by a user of wheeled luggage case 10 to be transferred to the large wheel pair 20, in accordance with the principles of the present invention.

FIGS. 2A and 2B illustrate another embodiment of the present invention featuring the high center-of-gravity of a large wheel-pair of wheeled luggage case 44. A dashed line 32 is shown representing the raised center of gravity of wheeled luggage case 44, and corresponds to the height from a surface 28 of the central axis of the large wheel pair 20 (seen as a single wheel in a side view). The wheeled luggage case 44 comprises a cylindrical storage chamber 34 substantially having the same profile as the large wheel pair 20. Only a small, standard carrying handle 36 is visible above the height of the large wheel pair 20. The cylindrical shape is of a convenient size for carrying on-board airlines and can be stowed as are other commonly used travel bags in low-profile storage areas, such as under seats.

The wheeled luggage case 44 is provided with a standard, extendable towing rod 38 and handle 40, and also has a unique foot member 42 for immobilizing the wheeled luggage case 44 when in a rest mode as shown in FIG. 2A, in accordance with the principles of the present invention.

FIG. 2B illustrates the towing mode of the wheeled luggage case 44 which is pulled at a forward tilting angle (curved arrow) over surface 28. The center-of-gravity (represented by line 32) lies at the central axis of the large wheel pair 20 so as to minimize the weight load on a user while pulling on towing rod 38. The immobilizing foot member 42 is raised from surface 28 (curved arrow) to allow wheel pair 20 to move forward.

FIGS. 3A-C show three pairs of side and three-quarter views to illustrate the three stages in the opening of the multi-sectioned cover of the wheeled luggage case of FIG. 1: fully closed (FIG. 3A), partially opened (FIG. 3B), and fully opened (FIG. 3C), respectively.

FIGS. 3A1-A2 is a side view and a three-quarter view, respectively, of the wheeled luggage case 10 from FIG. 1 shown in a rest mode. Multi-sectioned cover 14 is shown closed and latched with standard latching devices, such as clasps 46, as are known to those skilled in the art. The latching devices 46 may also be provided with key locks (not shown) or other security devices in a manner as is understood by those skilled in the art.

Figure 4:
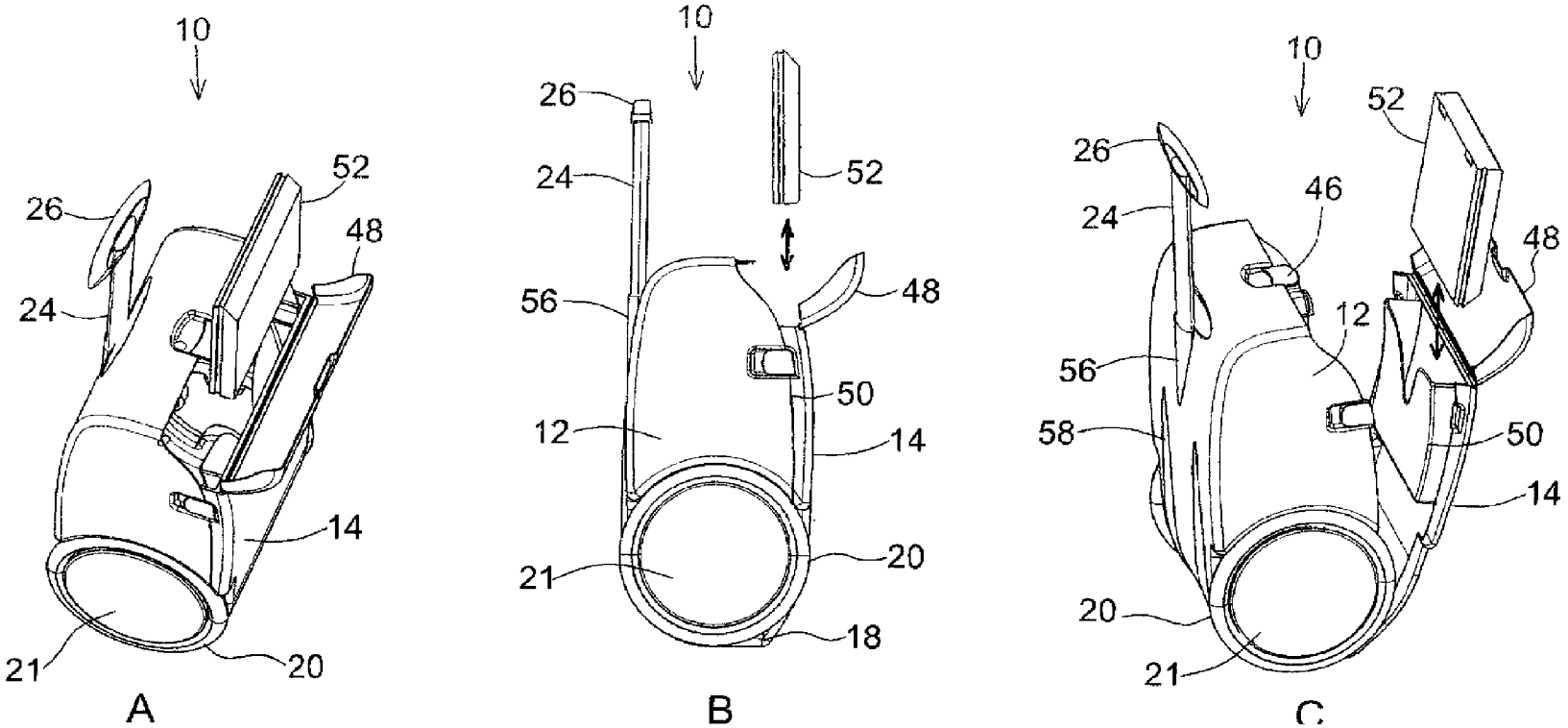
FIGS. 4A-C are views illustrating the disposition and exemplar use of an inside pocket formed within the storage chamber of the wheeled luggage case of FIG. 1.

FIGS. 3B1-B2 is a side view and a three-quarter view, respectively, of the wheeled luggage case of FIG. 1 showing only a top section 48 of the multi-sectioned cover 14 opened to conveniently access both the contents of the top portion of the storage chamber 12 and an inside pocket 50 formed within storage chamber 12 on an inner surface of multi-sectioned cover 14. The inside pocket 50 is useful for accommodating any flat-shaped object, but in the example shown, is preferably designed to hold a laptop computer or other electronic device (see FIG. 4).

Figure 2:
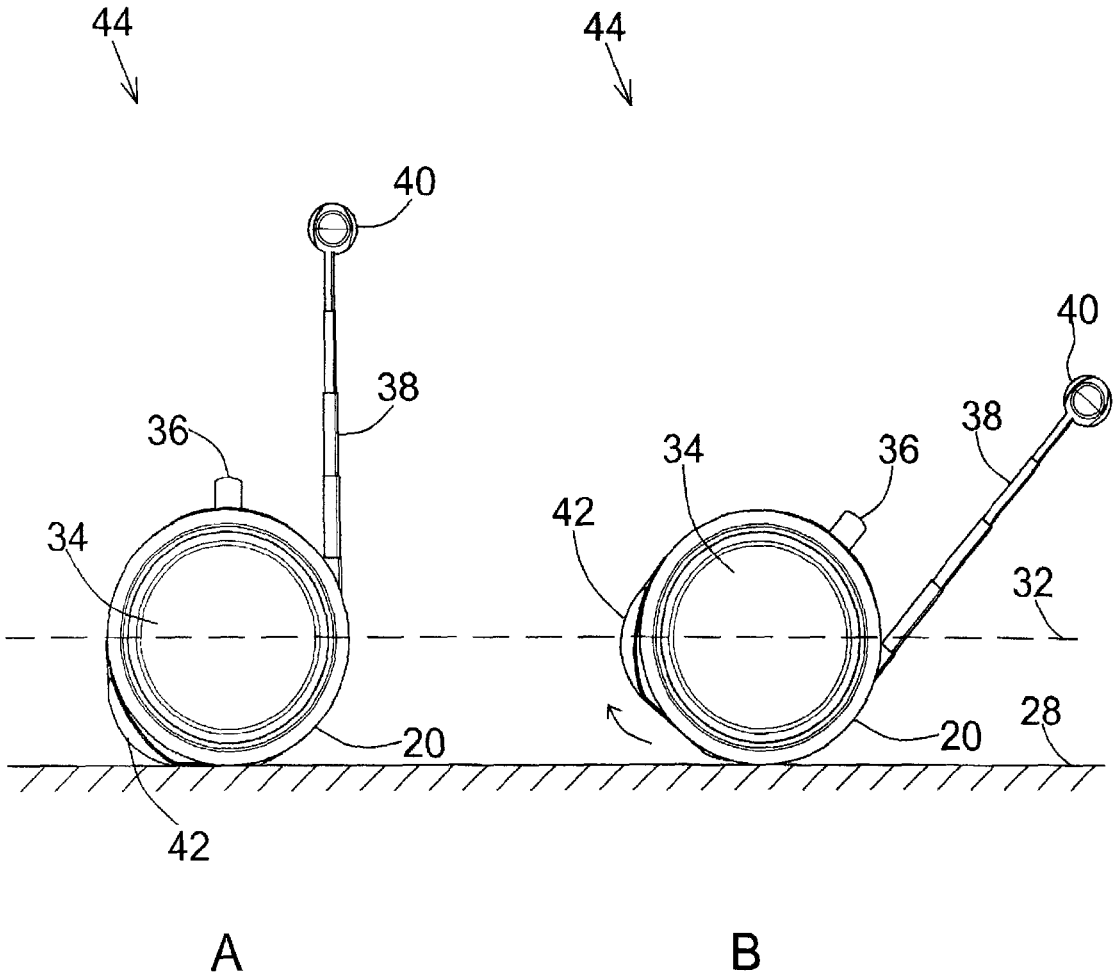
FIGS. 2A and 2B illustrate the high center-of-gravity of a large wheel-pair of another embodiment of the present invention.

FIGS. 3C1-2 is a side view and a three-quarter view, respectively, of the wheeled luggage case 10 from FIG. 1 shown in a rest mode with the multi-sectioned cover 14 in the process of being fully opened to access all the contents of storage chamber 12. The multi-sectioned cover 14 is hinged so as to be fully openable when the wheeled luggage case 10 is in an upright, rest mode as shown, but it may be opened whenever multi-sectioned cover 14 is exposed, such as when placed in a horizontal position on a surface with the multi-sectioned cover 14 facing up. One surface of storage chamber 12 is provided with ribbing 58 to provide added strength for sitting on the prone wheeled luggage case 10. Note that multi-sectioned cover 14 is fixedly hinged to the base 16 at the juncture of foot member 18.

FIGS. 4A-C show views illustrating the disposition and exemplar use of an inside pocket formed within the storage chamber of the wheeled luggage case of FIG. 1. The inside pocket 50 provides a convenient space for storing a thin object, such as a laptop computer 52. Other stored goods within storage chamber 12 are removable or insertable by fully opening the multi-sectioned cover 14 (as shown in FIG. 4C).

Wheeled luggage case 10 is provided with ribbing 58 integrally formed in the surface of storage chamber 12 both for design purposes, and for structural strength when laying the wheeled luggage case 10 to rest on its side with the outside surface of towing rod compartment 56 and ribbing 58 maintaining contact with a flat surface to allow a user to use the opposite side provided with the multi-sectioned cover 14 as a convenient place to sit. For this purpose, multi-sectioned cover 14, inside pocket 50, and storage chamber 12 as a whole are made of sturdy, lightweight material, such as rubber or molded plastic in a preferred embodiment of the present invention, although other suitable materials may also be used.

FIGS. 4A-B are three-quarter and side views, respectively, of wheeled luggage case 10 with multi-sectioned cover 14 shown partially opened so that a top section 48 allows access to an inside pocket 50. By way of example, a laptop 52 is shown being inserted into or removed from inside pocket 50 and is safely hidden from sight within inside pocket 50 when top section 48 of cover 14 is closed.

FIG. 4B shows a side view of the inside pocket 50 in an accessible position with the top section 48 opened and laptop 52 withdrawn. The multi-section construction enables partial opening to efficiently and conveniently access storage chamber 12, for example, to remove or insert a laptop computer 52 without disturbing other packed content. In a preferred embodiment of the present invention, multi-sectioned cover 14 is made from two parts, the top section 48 serving as a convenient, independent access to inside pocket 50 and to whatever contents lie at the top of storage chamber 12.

FIG. 4C shows a three-quarter view of wheeled luggage case 10 with cover 14 in the process of being fully opened so that access is had to all of the contents of storage chamber 12 and also to inside pocket 50. Notice that a fastener device, such as a quick-release latch 46 is also provided for the top section 48 to secure it in place and preferably, lock it.

The towing rod 24 with handle 26 are conveniently retracted when not in use into a towing rod pocket 56 formed integrally with storage chamber 12 and which form a balanced configuration with ribbing 58 for resting wheeled luggage case 10 in a prone position suitable to use as a platform for sitting.

FIGS. 5A and 5B are enlarged, detailed views of the large wheel pair of FIG. 1. In a preferred embodiment of the present invention, a set of four smaller wheels 22 are fixedly attached to the lower outside portion of storage chamber 12 and rotate along the inner rim 60 of each of the large wheel pair 20 similar to large roller bearings. The set of four smaller wheels 22 do not have a central rotational axis, but help distribute the load on each of the ring-type wheels of the large wheel pair 20.

Optionally, three smaller wheels disposed in a triangular configuration may be used in place of the set of four smaller wheels 22, or, depending on the space available and the overall physical dimensions of the large wheel pair 20, five or more smaller wheels may also be employed as may now suggest themselves to those skilled in the art.

In a preferred embodiment of the present invention, large wheel pair 20 rotates freely on a common axis, but without the need for a central axle since it rotates with the set of four smaller wheels 22. The absence of an axle advantageously simplifies manufacture, conveniently reduces the cost and the weight of the finished product, and avoids displacing valuable space within storage chamber 12 ordinarily used for accommodating an axle and supporting structure.

Nevertheless, in another embodiment of the present invention, such as with larger and heavier luggage cases (not shown), a central axle may alternatively and optionally be provided without detracting from the principles of the present invention. When, for example, a central axle is located at a point above or near the center-of-gravity of wheeled luggage case 10, the effect would be similar to that of the axle-less large wheel pair 20 of the present invention, relieving a user of much of the weight of the load when towing heavier luggage, and transferring it to the wheels The large wheel pair 20 is made of rubber/silicone which allows comfortable and efficient travel over many kinds of surfaces and under adverse conditions, such as rolling over small stones, snow, ice, and slippery ceramic flooring even though the large wheel pair may not be especially made for this.

Having described the invention with regard to certain specific embodiments, it is to be understood that the description is not meant as a limitation, since further modifications may now suggest themselves to those skilled in the art, and it is intended to cover such modifications as fall within the scope of the described invention.

I claim:

1. A wheeled luggage case comprising:

a storage chamber formed with a base;

a cover defining an opening on at least one side of said storage chamber for providing ready access therein;

a pair of freely rotating large wheels mounted on opposite sides of said luggage case having a common axis of rotation therebetween, said large wheels each having a diameter at least one third the height of said storage chamber;

a set of small, freely rotatable wheels mounted on each side of said luggage case in spaced apart fashion along the circumference of each of said pair of large wheels, each of said set of small wheels supporting one of said pair of large wheels by rolling contact with the circumference of said pair of large wheels;

a means for immobilizing said wheeled luggage case; and a means for towing of said wheeled luggage case;

wherein said luggage case has its center of gravity in a region proximate said common axis of rotation, and wherein said pair of large wheels provides support for said luggage case, bearing most of the weight load of said luggage case when towed by a user, such that when said storage chamber is tilted into an upright rest position, said immobilizing means and base are put into full contact with a ground surface, said pair of large wheels being lifted above said ground surface, such that said wheeled luggage case is maintained in an immobile rest position; and when said wheeled luggage case is tilted at an angle to said ground surface by action of said towing means, said immobilizing means and base are lifted away from contact with said ground surface, thereby restoring said pair of large wheels in contact with said ground surface, to allow rotation of said pair of large wheels on each of their respective said set of small wheels.

2. The wheeled luggage case of claim 1, wherein said pair of large wheels comprise at least a pair of freely-rotating wheels, each provided with a wheel cover.

3. The wheeled luggage case of claim 2, wherein said pair of large wheels is made from material for facilitating optimal roiling contact with a floor surface.

4. The wheeled luggage case of claim 3, wherein said material comprises rubber/silicone to enable rolling movement over a variety of surfaces and grading and under adverse environmental conditions.

5. The wheeled luggage case of claim 4, wherein said variety of surfaces and grading comprises at least one selected from the group: paved brick surfaces, paved stone surfaces, gravelly surfaces, rocky surfaces, irregular surfaces, curved surfaces, inclined surfaces, curbing, stairways and any combination thereof.

6. The wheeled luggage case of claim 1, wherein said small wheels are in rolling contact with an inner rim defining the circumference of said pair of large wheels.

7. The wheeled luggage case of claim 1, wherein said immobilizing means comprises a foot-member fixedly formed on an edge of said base for immobilizing said wheeled luggage case when placed in an upright position.

8. The wheeled luggage case of claim 1, wherein said means for immobilizing said wheeled luggage case comprises said base when brought into contact with a ground surface by tilting said luggage case into an upright rest position, said base being integrally formed with said storage chamber.

9. The wheeled luggage case of claim 1, wherein said cover defines an opening on said at least one side of said storage chamber for providing secure and safe storage access to only a portion of an interior section thereof.

10. The wheeled luggage case of claim 9, wherein said interior section portion comprises at least one pocket formed within a section of said luggage case proximate to an outer opening thereof.

11. The wheeled luggage case of claim 9, wherein said storage access accommodates a portable device.

12. The wheeled luggage case of claim 11, wherein said portable device comprises a laptop computer.

13. A wheeled luggage case system comprising:

a storage chamber formed with a base and having a secure space for holding and transporting moveable goods;

a cover defining an opening on at least one side of said storage chamber for providing ready access to all portions therein;

a pair of freely rotating large wheels mounted on opposite sides of said luggage case having a common axis of rotation therebetween, said large wheels each having a diameter at least one third the height of said storage chamber;

a set of small, freely rotatable wheels mounted on each side of said luggage case in spaced apart fashion along the circumference of each of said pair of large wheels, each of said set of small wheels supporting one of said pair of large wheels by rolling contact with the circumference of said pair of large wheels;

a means for immobilizing said wheeled luggage case; and a means for towing of said wheeled luggage case;

wherein, when said storage chamber is closed with said cover and said wheeled luggage case is tilted at an angle to a ground surface by action of said towing means, said immobilizing means and base are lifted away from contact with said ground surface allowing rotation of said pair of large wheels on each of their respective said set of small wheels, said large wheels bearing most of the weight of said wheeled luggage case, the weight being distributed among said set of small wheels, relieving said weight load on a user; and when said storage chamber is tilted into an upright rest position in relation to a ground surface, said immobilizing means and base are put into full contact with said ground surface to restrain rotation of said, pair of large wheels and said wheeled luggage case is maintained in an immobile rest position.

* * * * *